United States Patent [19]

Nakamura et al.

[11] 4,229,522

[45] Oct. 21, 1980

[54] METHOD FOR FORMING COLOR IMAGES

[75] Inventors: Shigeru Nakamura; Isao Shimamura; Taku Nakamura; Shinji Sakaguchi; Takushi Miyazako; Masatoshi Sugiysma; Akio Mitsui, all of Minami-ashigara, Japan

[73] Assignee: Fuji Photo Film Co., Ltd., Minami-ashigara, Japan

[21] Appl. No.: 30,045

[22] Filed: Apr. 13, 1979

Related U.S. Application Data

[63] Continuation-in-part of Ser. No. 954,950, Oct. 26, 1978, abandoned.

[30] Foreign Application Priority Data

Oct. 26, 1977 [JP] Japan ..... 52-128389

[51] Int. Cl.[2] ..... G03C 7/00

[52] U.S. Cl. ..... 430/390; 430/449; 430/462; 430/630; 430/943

[58] Field of Search ..... 430/390, 393, 449, 462, 430/943, 630

[56] References Cited

U.S. PATENT DOCUMENTS

| | | | |
|---|---|---|---|
| 2,564,238 | 7/1951 | Sprung | 430/390 |
| 3,040,012 | 6/1962 | Maeder | 430/461 |
| 3,259,497 | 7/1966 | Wartburg | 430/390 |
| 3,455,690 | 7/1969 | Schaefer et al. | 430/390 |
| 3,716,362 | 2/1973 | Meier | 430/390 |
| 3,772,020 | 11/1973 | Smith | 430/461 |
| 3,773,509 | 11/1973 | Ohyama et al. | 430/390 |

*Primary Examiner*—J. Travis Brown

*Attorney, Agent, or Firm*—Sughrue, Rothwell, Mion, Zinn and Macpeak

[57] ABSTRACT

A method for forming color images comprising processing a photographic element containing imagewise distributed silver in the presence of a polymer containing at least 30 mol % vinyl pyridines, a dye and an oxidizing agent to thereby oxidation-bleach the dye. Color images having excellent light fastness, heat resistance and humidity resistance are obtained.

16 Claims, 2 Drawing Figures

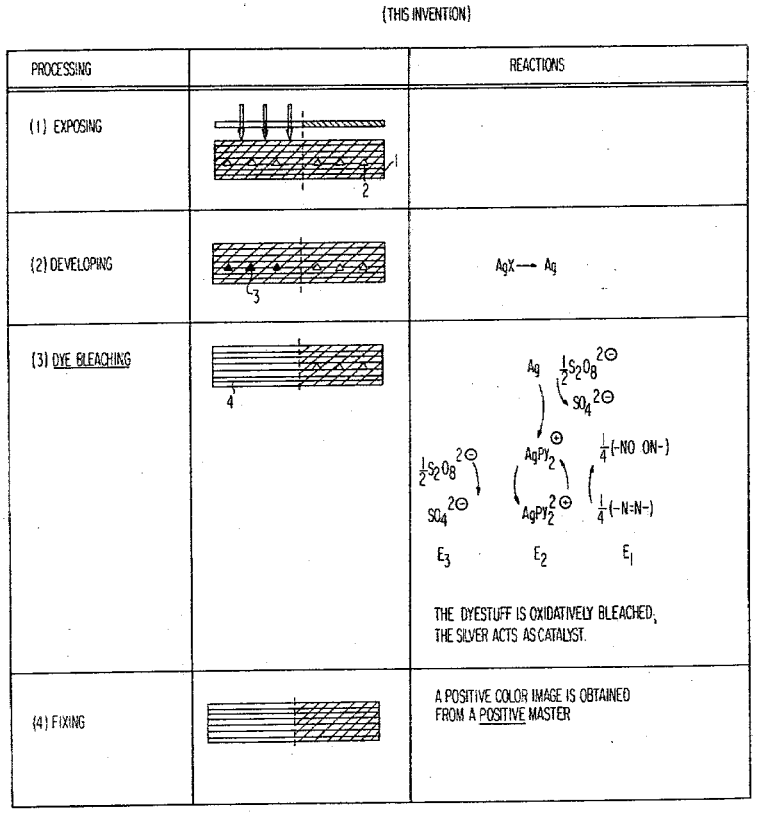

NOTE:
1- DYESTUFF
2- PHOTOSENSITIVE SILVER HALIDE GRAIN
3- DEVELOPED SILVER
4- HORIZONTAL LINES MEANS THE PRESENCE OF POLYMER
Py- PYRIDINE UNIT INCORPORATED IN THE POLYMER
X- HALOGEN

FIG 1 (THIS INVENTION)

| PROCESSING | | REACTIONS |
|---|---|---|
| (1) EXPOSING | 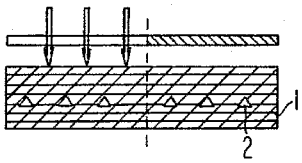  | |
| (2) DEVELOPING | 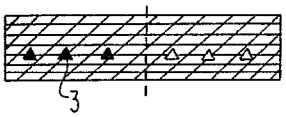  | $AgX \longrightarrow Ag$ |
| (3) DYE BLEACHING | 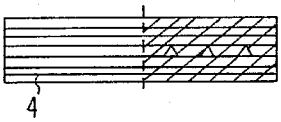  | 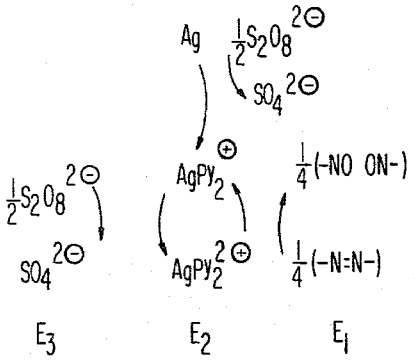  THE DYESTUFF IS OXIDATIVELY BLEACHED; THE SILVER ACTS AS CATALYST. |
| (4) FIXING | 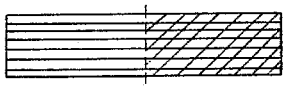 | A POSITIVE COLOR IMAGE IS OBTAINED FROM A POSITIVE MASTER |

NOTE:
1- DYESTUFF
2- PHOTOSENSITIVE SILVER HALIDE GRAIN
3- DEVELOPED SILVER
4- HORIZONTAL LINES MEANS THE PRESENCE OF POLYMER
Py- PYRIDINE UNIT INCORPORATED IN THE POLYMER
X- HALOGEN

FIG 2

| PROCESSING | | REACTIONS |
|---|---|---|
| (1) EXPOSING | 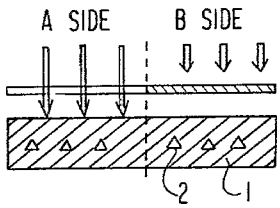 | |
| (2) DEVELOPING | 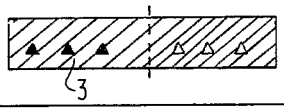 | AT A SIDE ONLY:<br>$AgBr \rightarrow Ag^{o}$ |
| (3) SILVER BLEACHING | 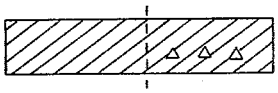 | AT A SIDE ONLY:<br>$Ag^{o} \rightarrow Ag^{\oplus}L_2$ (REMOVED)<br>THE DYESTUFF IS NOT ATTACKED (COLUMN 4, LINES 32-33) |
| (4) REVERSAL DEVELOPING | 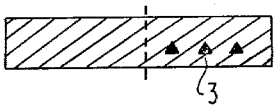 | AT B SIDE:<br>$AgBr \rightarrow Ag^{o}$ |
| (5) DYE BLEACHING | 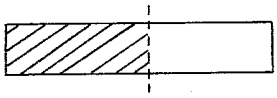 | $Ag^{o}$ $A$ $-NH_2$ $H_2N-$<br>$Ag^{\oplus}L$ $AH_2$ $-N=N-$ |
| (6) FIXING | 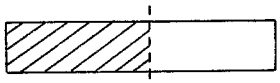 | A POSITIVE COLOR IMAGE FROM A NEGATIVE MASTER. (COLUMN 4, LINES 15-16) |

NOTE-
1-DYESTUFF
2-PHOTOSENSITIVE SILVER HALIDE GRAIN
3-DEVELOPED SILVER
4-CATALYST
L-COMPLEXING AGENT

METHOD FOR FORMING COLOR IMAGES

CROSS REFERENCE TO RELATED APPLICATION

This application is a Continuation-in-Part of U.S. patent application Ser. No. 954,950, filed Oct. 26, 1978 by Shigeru Nakamura et al and entitled Method For Forming Color Images, now abandoned.

BACKGROUND OF THE INVENTION

1. Field of the Invention

The present invention relates to a method for forming color images, and, more particularly, to a method for forming color images which comprises processing a photographic element containing imagewise distributed silver in the presence of a complexing agent, an oxidizing agent and a dye to thereby oxidatively bleach the dye.

2. Description of the Prior Art

A general method for forming color images is a method for obtaining an azomethine or indoaniline dye which comprises processing a silver halide light-sensitive material with an aromatic primary amine developing agent in the presence of one or more couplers. This color development technique using silver halide is based upon the method invented by L. D. Mannes & L. Godowsky, which has since then involved a variety of improvements and is now universally adopted in this art.

The color development method using an aromatic primary amine developing agent involves the following disadvantages:

(1) The dye formed shows poor light fastness, heat resistance and humidity resistance and the color images suffer marked discoloration with the passage of time.

(2) The aromatic primary amine developing agent is hazardous to the skin, e.g., causing skin poisoning, and, for this reason, the developer must be carefully used.

(3) Since dye images and the oxidation product of the color developing agent must be present in equivalent amounts, it is theoretically impossible to reduce the silver halide participating in the formation of the dye images to an amount less than the amount stoichometrically required. Known techniques for reducing the silver halide amount include a method for reducing silver halide that is present in an excess amount than that stoichiometrically required amount as must as possible, on one hand, and on the other hand, a method for reducing the amount stoichiometrically required per se. With regard to the latter technique, for example, 2-equivalent couplers have been developed which can form one mol of a dye by two mols of silver halide. However, even with this technique, it is not possible to reduce the amount of the silver halide in the light-sensitive material to an amount less than ½ that of the light-sensitive material containing the 2-equivalent couplers.

A color photographic process other than the above-mentioned processes employed at present is based on a silver-dye-bleach photographic process. This process is also based on the color photographic process disclosed in U.S. Pat. No. 2,270,118 and, since zero dyes are used in the color process, the color images formed by the process generally have excellent light resistance, heat resistance and moisture resistance.

A typical photographic element used for the silver-dye-bleach color photography has three silver halide photographic emulsion layers respectively sensitized to red, green, and blue light, and having associated therewith, respectively, and bleachable cyan, magenta and yellow dye. Such a photographic element provides color photographic positive images through the following processing:

(1) The photographic element is image-wise exposed.

(2) The exposed photographic element is developed in a silver halide developer to form negative silver images, the photographic element is then processed in a dye bleach bath which oxidizes the silver images to a silver salt and concurrently decolorizes the associated dye pattern, and, finally the photographic element is fixed and washed to remove the residual silver salt, whereby dye images are obtained which are photographically the reverse of the initial silver images. The silver-dye-bleach process is generally described in, for example, U.S. Pat. Nos. 3,498,787 and 3,503,741, Canadian Pat. No. 790,533 and A. Meyer, "Some Features of the Silver-Dye Bleach Process", *The Journal of Photographic Science,* Vol. 13, 90–97 (1965).

In the silver dye bleach process as described in U.S. Pat. No. 2,270,118, dye images are formed by processing dye-containing layers having silver images with an acid solution which decomposes the dyes at the silver-containing areas. The decomposition or destruction of the dye is accelerated by various "catalysts" such as phenazine. Also, the reaction in these dye bleach systems is considered to proceed on a stiochiometric basis (for example, it is suggested that 4 atoms of silver are required for decomposing one azo dye group in Column 1, lines 18–21 of U.S. Pat. No. 3,340,060).

However, these silver dye bleach processes have the following disadvantages:

(1) Since a large amount of silver is required for bleaching the dyes, the photosensitive materials must contain a large amount of silver halide in the silver halide photographic emulsion layers.

(2) Since a strongly acidic processing solution which is highly corrosive is usually used in these processes, difficulties are encountered in preserving and handling the solution.

Recently, numerous investigations have been made for saving silver as a resource, increasing the efficiency of the reaction system, and improving the quality of the color images formed by reducing the amount of silver required to decompose each molecule of dye.

Several patents are known which deal with various types of silver dye bleach image forming processes, for example, U.S. Pat. No. 3,716,362 Meier, U.S. Pat. No. 3,259,497 Wartburg and U.S. Pat. No. 2,564,238 Sprung. These patents are discussed below and compared to the present invention, disclosure relative to the present invention not being part of the prior art, of course, but being offered to offer a valid comparison to the prior art. Reference should also be made to later discussed FIG. 2 for a complete understanding of the subject matter involved.

Turning to U.S. Pat. No. 3,716,362, this patent teaches a process at column 1 lines 64 to 65 wherein metallic silver is removed from a photographic material without decomposition of a dye. That is, the reaction of $Ag^{\circ} \rightarrow Ag + L_2$ occurs in this process as shown in FIG. 2. Further, the reaction of Meier involves materials which exhibit the following relationship between their complex forming constant and oxidation-reduction potential:

$$E^\circ(AgL_2^\oplus + e^\ominus \rightleftarrows Ag^\circ + 2L) = E^\circ(Ag^\oplus \rightleftarrows Ag^\circ) - (RT/F)\ \ln K_1$$

where R, F and T denote gas constant, Faraday constant and temperature respectively. When a complexing agent is present, $E^\circ(Ag^+ \rightarrow Ag^\circ)$ is constant and, therefore, the oxidation-reduction potential of Ag can be represented by the complex forming constant $K_1$.

On the other hand, the present invention teaches a process in which a dye is decomposed at the areas where silver is present, i.e., metallic silver is oxidized by a peroxo sulfate into the Ag(I)-polymer complex (hereinafter, "Ag(I)-polymer complex" is referred to "silver complex") and the Ag(I)-polymer complex is further oxidized by the peroxo sulfate into the Ag(II)-polymer-complex. In the reaction the complexing agent acts to reduce the oxidation-reduction potential of silver (i.e., $Ag^\oplus \rightarrow Ag^{2\oplus}$); thus, this process can be schematically illustrated as follows:

$$E^\circ(Ag^{2\oplus}\ Py_2 + e^\ominus \rightleftharpoons Ag^\oplus\ Py_2) = E^\circ(Ag^{2\oplus} \rightleftharpoons Ag^\oplus) - \frac{RT}{F}\log\frac{K_2}{K_1}$$

where $K_2$ represents the complex forming constant with $Ag^{2\oplus}$, $K_1$ represents the complex forming constant with $Ag^\oplus$, and Py represents the pyridine unit of the polymer. As is apparent from the above schematic, the complex forming constants directly influence the reaction in the form $K_1/K_2$ and, therefore, E° cannot be expressed by $K_1$ as in Meier.

The process of this invention differs from the process of Meier as follows:

Meier's process:

Exposure → Developing → Metallic Silver Removal* → Reversal Developing → Dye Bleaching → Silver Bleaching → Fixing

*Dye bleaching does not occur in the Metallic Silver Removing bath, i.e., this processing merely removes metallic silver.

The Process of This Invention

Exposure → Developing → Dye Bleaching** → Fixing (or Blix)

**Oxidation of silver and dye bleaching occur simultaneously in the Dye Bleaching bath.

In addition, the process of this invention provides a posi-posi image, while the process of Meier provides a nega-posi image, i.e., the process of this invention provides the same image as the master while the process of Meier provides a reversed image to the master.

Further, in Meier an acid bath is used which has the following composition:

Oxidant: Cu(II) salts, quinones or Fe(III) salts; [E° of the oxidant is within the range of +0.15 to +0.8 volt, preferably +0.4 to +0.8 volt]; (Meier, column 2 lines 8 to 12)

Complexing Agent: nitriles, heterocyclic amines or thioethers; (Meier, column 2 lines 34 to 36)

pH: below 6; (Meier, column 3 line 41)

The dye bleaching bath of this invention has the following compositions:

Oxidizing Agent: peroxo acid or a salt thereof

Complexing Agent: heterocyclic amine pH: 1 to 7.

Thus, while the complexing agent and pH used in this invention overlap with Meier, the oxidizing agent used in the dye bleaching bath of this invention is quite different from the oxidant used in the acid bath of Meier. The oxidant of Meier has only a weak oxidizing ability to metallic silver (i.e., the E° of Meier's oxidant is preferably +0.4 volt to +0.8 volt) and, therefore, metallic silver can be oxidized into Ag(I) but cannot by oxidized into Ag(II) by the oxidant. The oxidizing agent of this invention has a very strong oxidizing ability to metallic silver (for example, the E° of peroxodisulfuric acid is 2.01 volt) and, therefore, metallic silver can be oxidized into Ag(II) and the dye can be oxidatively decomposed by the resulting Ag(II).

U.S. Pat. No. 3,259,497 Wartburg is directed to the same silver-dye-bleach nega-posi process as Meier, and teaches at column 1 lines 56 to 60 that silver bleaching can be carried out without dye decomposition. In the process of this invention, dye is oxidatively bleached in the presence of silver. Thus, the process of this invention is quite different from the process of Wartburg.

U.S. Pat. No. 2,564,238 Sprung teaches at column 1 lines 13 to 18 that dye is reductively decomposed by metallic silver. In the process of this invention, dye is oxidatively decomposed by a oxidizing agent using silver as a catalyst to obtain an image, i.e., the dye bleaching solutions of this invention contain a strong oxidizing agent. Therefore, the process of this invention is quite different from that of Sprung.

In commonly assigned application Ser. No. 840,459, filed Oct. 7, 1977, it has been proposed that α,α'-dipyridyl or α-picolinic acid by employed as a complexing agent. However, these complexing compounds involve the following disadvantages.

(1) Due to a small size of the complexing agent, the resulting Ag complex moves relatively easily within the photographic element. This means that, since the Ag complex must react with the dye to thereby bleach the dye, the dye is bleached over a wider area than the imagewise exposed area and the sharpness of the images formed is reduced or impaired.

(2) In the system where the oxidizing agent and the complexing agent are present in the processing solution, continuous processing results in decomposition of the oxidizing agent, which adversely affects stability of the processing solution.

These disadvantage have been solved in accordance with the present invention by the use of a polymer type complexing agent.

The complexing agent used in the present invention fixes the silver in the photographic element. As a result, Ag is unable to move within the element easily and the problem of blurred images is solved. In addition, because the complexing agent is always present in the vicinity of the dye, the bleaching speed of the dye is markedly accelerated. The complexing agent is not present in any processing solution and, therefore, the stability of the processing solution is maintained.

A wide variety of studies have been made in an effort to achieve high efficiency of this reaction system, save resources and improve image quality, by reducing the amount of silver necessary for decomposing 1 mol of a dye.

SUMMARY OF THE INVENTION

An object of this invention is, therefore, to provide a process of forming color images having excellent light resistance, heat resistance and moisture resistance using light-sensitive materials containing a reduced amount of silver salt or silver.

Another object of this invention is to provide a process of forming color images having excellent light resistance, heat resistance and moisture resistance without using chemicals causing pollution problems.

Still another object of this invention is to provide a process of forming color images which are stable to light, heat and moisture using a processing solution which is less corrosive.

These objects of this invention are attained by a process of forming color images which comprises processing an image-wise exposed and developed photographic element having developed silver image-wise distributed therein in the presence of a polymer containing at least 30 mol% of vinylpyridine compound, a peroxo acid or a salt thereof and a dye.

BRIEF DESCRIPTION OF THE DRAWINGS

FIG. 1 is a schematic representation of processing steps and reactions which occur in the present invention.

FIG. 2 is a schematic representation of a conventional silver dye bleaching process.

DETAILED DESCRIPTION OF THE INVENTION

In one preferred embodiment of this invention, a photographic element having a silver halide emulsion, dye and polyvinylpyridine is image-wise exposed and developed, whereby image-wise distributed developed silver is produced in the photographic element. Then, the resulting photographic element is processed with a dye bleaching bath containing a peroxo acid or a salt thereof, whereby the dye is oxidatively bleached at areas where developed silver is present to provide color positive images as shown in FIG. 1.

In the dye bleaching bath of this invention (see FIG. 1), developed silver (i.e., Ag) in the photographic element is oxidized into a monovalent silver-polymer complex (i.e., $AgPy_2^{\oplus}$, wherein $Py_2$ represents the pyridine unit incorporated into the polymer) by the peroxo acid or a salt thereof in the presence of the polymer; the resulting monovalent silver-polymer complex is further reacted with the peroxo acid or a salt thereof to produce a divalent silver complex having high capability to oxidize the dye (i.e., $AgPy_2^{2\oplus}$) and an oxo acid radical. The resulting divalent silver complex oxidatively decomposes the dye and, simultaneously, the divalent silver complex itself is reduced back to a monovalent silver complex. The resulting monovalent silver complex is again reacted with the peroxo acid or a salt thereof to produce the divalent silver complex and the oxo acid radical. Thus, the silver itself acts as a catalyst, and, hence, color positive images can be obtained with a very small amount of silver.

Silver ions present in a silver halide cannot be oxidized into the divalent silver complex form mentioned above by the peroxo acid or a salt thereof because the silver ion is halogenized. Thus, this invention is based on a principle which is quite different from that of conventional silver dye bleaching image forming processes.

The polyvinylpyridine employed as the complexing agent in this invention can strongly form a complex with a silver divalent ion, which makes oxidation of the siler monovalent complex into the silver divalent complex easy. The silver divalent complex produced must have a sufficient ability to oxidize the dye, that is, the complexing agent, the peroxo acid or a salt thereof and the dye employed in this invention must meet the relationship $$E_3 > E_2 > E_1 \quad (1)$$

wherein $E_1$ represents the potential causing the oxidative bleaching reaction of the dye, $E_2$ represents the oxidation-reduction potential of the Ag(I)/Ag(II) pair in the presence of the polyvinylpyridines and $E_3$ represents the reduction potential of the peroxo acid or salt thereof.

Silver-dye-bleach photographic processes (e.g., the Gaspor color process) are known as conventional processes for forming an image by the bleaching of a dye; however, the process of this invention is quite different from conventional silver-dye-bleach photographic processes as explained above.

FIG. 2 illustrates a negative-positive process of the conventional silver-dye-bleach type as described in U.S. Pat. No. 3,716,362 to Meier. According to the Meier process, after a photographic material is exposed (process step (1) in FIG. 2) and black-and-white developed (process step (2) in FIG. 2), the photographic material is processed with an acid bath (i.e., a silver bleaching bath) containing an oxidant and a complexing agent, whereby developed silver in the photographic material is converted to a soluble silver complex and the soluble silver complex is removed from the photographic material (process step (3) in FIG. 2). In process step (3), dye present in the photographic material must not be decomposed so that a weak oxidant which cannot oxidize the dye and a complexing agent for monovalent silver ion are used in the acid bath.

The photographic material is thus again black-and-white developed (process step (4) in FIG. 2), whereby silver halide remaining in the photographic material is reduced to silver and a photographic material containing uniformly distributed dye and an image-wise distributed developed silver is obtained.

The resulting photographic material is then treated with a processing solution (i.e., the dye bleaching bath in FIG. 2) containing an acid, a complexing agent for silver monovalent ion and a catalyst such as phenzaine, whereby the dye in the photographic material is bleached.

The mechanism of this bleaching reaction is described in Mason, *Photographic Processing Chemistry*, The Focal Press (1975). According to Mason, the silver acts as a reducing agent for the catalyst such as phenazine (i.e., the catalyst is reduced by the silver) and azo dye at silver-containing areas is reduction-bleached by the reduced catalyst. The bleaching in this mechanism is a reduction-bleaching and an amount of silver equivalent to that of the azo dye must be used and any silver monovalent complex produced is not re-utilized.

According to the method of the present invention, silver or silver ions acts as a catalyst for the oxidation of the dye by the oxidizing agent so that the amount of silver or silver salt in the light-sensitive element can be reduced markedly. As compared to the conventional silver dye bleach process, the dye can be sufficiently bleached with an amount of silver less than 1/5.

A conventional photographic material contains a silver salt in an amount of 3 to 10 g/m$^2$ calculated as silver and even in the case of a printing material, silver is present in an amount of approximately 1 to 4 g/m$^2$. In the photographic element in accordance with the present invention, the amount of silver coated is less than 3 g/m$^2$ and, in particular, less than 2 g/m$^2$ may be sufficient. A lower limit for the amount of coated silver is preferably 1 mg/m$^2$. Where the element is a multilayer photographic light-sensitive element, the coated amount of silver is less than 1 g/m$^2$ per light-sensitive layer and more preferably between 0.5 g/m$^2$ and 1 mg/m$^2$.

According to the present invention, color images are formed by treating the light-sensitive material containing imagewise distributed silver in the presence of the dye, the polymer containing at least 30 mol% of the polyvinylpyridine and the oxidizing agent to thereby oxidatively bleach the dye. The dye and the polymer may be incorporated into a silver halide emulsion layer together or in a layer adjacent a silver halide emulsion layer. In the latter case, the silver ion, which is formed from imagewise distributed silver by the oxidizing agent, diffuses into the adjacent layer for oxidative processing. However, the dye need not be present in the silver halide emulsion layer or the adjacent layer together with the polymer as long as the dye can diffuse to the polymer layer for oxidative bleaching. For example, the dye can be in a separate processing solution or layer in the form of a DDR coupler or a DRR compound. The oxidizing agent may be present in the silver halide emulsion layer, an adjacent layer or preferably in a separate processing solution.

Summarizing, it should be clear from the foregoing discussion that in accordance with the present invention, the polymer serves to anchor the silver halide and to render it non-diffusible such that upon development blurred images do not occur. Consequently, for oxidative bleaching, dye oxidizing agent and silver halide must be brought to the polymer layer. In the case of the dye and oxidizing agent which are relatively mobile in the photographic element, they can be inocrporated into the polymer layer or in an adjacent layer or in a separate processing solution. In the case of the silver halide, it may be incorporated directly into the polymer layer or in an adjacent layer. In order to avoid the possibility of desensitization, it is preferable to separate dye, and silver halide and oxidizing agent. Accordingly, the oxidizing agent is preferably used in its own processing solution and the dye and polymer are preferably incorporated into a layer adjacent the silver halide emulsion layer.

One preferred embodiment of the present invention comprises imagewise exposing a photographic element comprising at least one layer containing a silver halide emulsion, a dye and a polymer containing at least 30 mol% of the vinylpyridine, imagewise developing the element to form developed silver, and then processing the element with a bath containing the oxidizing agent to thereby bleach the dye in the areas where developed silver is present. Color positive images are thus obtained.

In another embodiment of the present invention, color negative images are obtained by using direct positive silver halide emulsion as the aforementioned silver halide emulsion. Direct positive silver halide emulsions are discussed in Mees, *The Theory of Photographic Process,* pp. 261–297 (1942), Macmillan Inc., New York. There are two types of direct positive emulsion; one is the solarization type emulsion and another is the internal latent image type direct positive emulsion. The latter is described in British Pat. Nos. 443,245 and 462,730, U.S. Pat. Nos. 2,005,837, 2,541,472, 3,367,778, 3,501,305, 3,501,306 and 3,501,307. These U.S. Patents disclose representative preparations of the internal latent image type emulsion.

In another embodiment of the present invention, positive images are obtained by imagewise exposing a photographic element comprising at least one silver halide emulsion layer containing a polymer containing at least 30 mol% of the vinylpyridine, developing, then impregnating the photographic element with a dyeing bath to cause dyeing and adhere thereto, and then impregnating the dyed element with a bath containing the oxidizing agent to thereby bleach the dye.

In a further embodiment of the present invention, the dye, polyvinylpyridine polymer and oxidizing agent are provided in one layer and a light-sensitive layer containing silver halide provided separately in an adjacent layer. After exposure, a viscous processing solution containing a developing agent and a silver halide solvent is employed to dissolve the undeveloped silver halide by the action of the silver halide solvent and diffuse silver ions into the dye layer to thereby imagewise bleach the dye. In this method, the dye, polyvinylpyridine polymer and oxidizing agent can also be incorporated into separate layers, or a part thereof can be incorporated into a processing solution. In addition, a combination of the dye layer and the silver halide layer can also be a three-layered structure of a red sensitive layer, green sensitive layer and a blue sensitive layer. Further, auxiliary layers can additionally be supplemented thereto.

A further embodiment of the present invention is to utilize print-out silver images which are formed by imagewise exposing the silver halide light-sensitive element. This kind of light-sensitive materials includes those containing known halogen-receptive compounds, and those containing an easily heat-decomposable silver salt such as fatty acid silver salts, etc. See Mees and James, *The Theory of Photographic Process,* 3rd Ed., Page 92 (1966), Macmillan Inc., New York. In the present invention, color positive images are obtained by exposing the photographic element containing these silver salts and dyes to form print-out silver images, and then impregnating the element with a bath containing the oxidizing agent and the complexing agent to bleach the dye in the area in which the print-out silver images are present.

These embodiments become practically possible by using the polymer containing the pyridine ring. That is, the pyridine ring loses its diffusibility due to the fact that the ring is part of the polymer molecule. Thus, it can be fixed in one layer of the photographic element and does not diffuse into the other layers of the photographic element. Furthermore, accompanying this effect, the silver ions which are catalysts for the dye bleaching greatly lose their diffusibility such that the phenomenon that images obtained by photographic processing of the photographic element are not sharp does not occur. In addition, by incorporating the complexing agent for silver in the photographic element, the complexing agent can be removed from the dye bleach solution and the stability of the dye bleach solution is improved.

Considering the above, it will be understood that, in order to realize the aforesaid various embodiments, the polymer containing a group which functions as a complexing agent for silver, such as a pyridine ring, is indispensable.

A wide variety of compounds can be used as the oxidizing agent so long as they are selected from peroxo acids and the salts thereof used in this invention which satisfy the oxidation reduction conditions shown by relationship (1) described above to the silver potential in the presence of a complexing agent. The term "peroxoic acid" as used herein refers to an acid in which an $O_2$ group (peroxo) is coordinated as opposed to the oxygen atom in the acidic acid. Further, the peroxoic acid is an acid which is formed by the reaction of hydrogen peroxide and an oxygen acid, or an acid which forms hydrogen peroxide upon reacting with diluted sulfuric acid. As peroxoic acids, there are known peroxonitrate, peroxocarbonate, peroxodisulfate (persulfate), peroxosulfate, peroxoborate, peroxophosphate, peroxotungstenate, peroxotitanate, etc. The peroxoic acid salts which are employed in accordance with the present invention include salts of alkali metals (lithium, sodium, potassium, etc.), alkaline earth metals (magnesium, calcium, etc.) and ammonium, of the peroxoic acids. Persulfates (e.g., potassium persulfate, sodium persulfate, ammonium persulfate, etc.) are employed as the most preferred oxidizing agents.

The polymer containing at least 30 mol% of a vinylpyridine which is employed in accordance with the present invention includes a homopolymer obtained by polymerizing singly vinylpyridines having the structural formula (II):

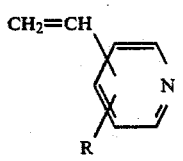

(II)

wherein R represents a hydrogen atom or a straight chain or branched chain lower alkyl group having 1 to 6 carbon atoms, and a copolymer obtained by copolymerizing the vinylpyridines with other ethylenically unsaturated monomers.

Examples of the vinylpyridines having the structure of the formula (II) include 2-vinylpyridine, 3-vinylpyridine, 4-vinylpyridine, 2-methyl-5-vinylpyridine, etc., and preferred examples of the homopolymers are poly-2-vinylpyridine, poly-4-vinylpyridine, etc.

Typical examples of the ethylenically unsaturated monomers which are copolymerized with the vinylpyridines include styrene, vinyl acetate, methyl acrylate, methyl methacrylate, acrylamide, acrylonitrile, alkyl vinylpyridinium salts (e.g., halogen ions, etc., as a pair ion), etc. Styrene is preferred. In this case, it is preferred that more than 30 mol% of the repeating units of the copolymer, preferably more than 50 mol% of the copolymer, be vinylpyridines having the structural formula (II).

The polymer containing at least 30 mol% of the vinylpyridines which can be employed in the present invention is synthesized by polymerizing singly or copolymerizing the vinylpyridines having the structure of the formula (II) with other ethylenically unsaturated monomers. It is also possible to prepare the polymer in conventionally known manners, for example, by using any one of mass polymerization, precipitation polymerization, solution polymerization, pearl polymerization, emulsion polymerization and so on. Further, polymerization catalysts such as peroxides (e.g., benzoyl peroxide), azo compounds (e.g., 2,2'-azobis(2-methylpropionitrile)), sulfuric acid, n-butyl lithium, etc., can also be adopted for the polymerization. These synthetic processes are described in, for example, U.S. Pat. Nos. 3,208,964, 2,673,194 and 2,715,118, *Industrial and Engineering Chemistry*, Vol. 42, page 1603, by Emerson B. Fitzgerald and Raymond M. Fuoss, et al., (1950), etc.

The polymer containing at least 30 mol% of the vinylpyridines which is employed in the present invention can easily be obtained in a variety of molecular weights, as is well known in the prior art, by modifying the solvent, monomer concentration, catalyst, concentrations, temperature and the like, in a variety of polymerization processes; however, the polymer having molecular weight of from 5,000 to 1,000,000 is generally employed for the present invention. A preferred molecular weight range is 20,000 to 300,000.

Examples of the polymer employed in the present invention is shown below.

1. Poly-2-vinylpyridine

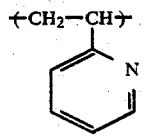

2. Copoly(4-vinylpyridine-styrene)

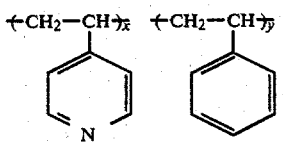

x:y = 50:50

3. Copoly(4-vinylpyridine-n-butyl-4-vinylpyridinium bromide)

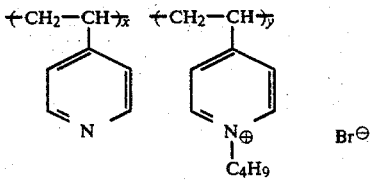

x:y = 75:25

4. Copoly(4-vinylpyridine-styrene-benzyl-4-vinylpyridinium chloride)

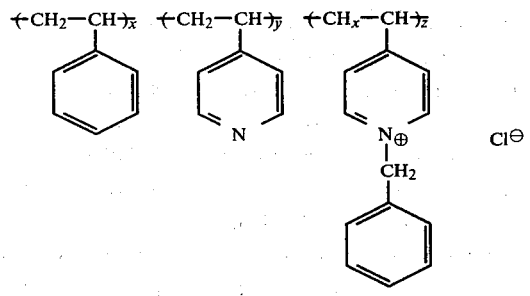

x:y:z = 50:35:15

5. Poly-4-vinylpyridine

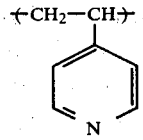

6. Copoly(4-vinylpyridine-styrene)

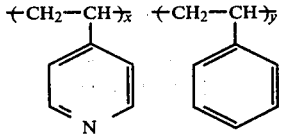

x:y =: 75:25

Useful examples of the other polymers which are employed in the present invention include, e.g., poly-3-vinylpyridine, copoly(4-vinylpyridine-benzyl-4-vinylpyridinium chloride) and the like. As stated above, in the copolymer, more than 30 mol% of the repeating units, preferably more than 50 mol% must be vinylpyridines having the structure of the aforementioned formula (I).

Some copolymers containing more than 30 mol% of the aforementioned vinylpyridines are water-insoluble in a neutral solution thereof; in this case, these copolymers are incorporated into the photographic element either by dissolving in an acidic solution of pH 3 to 5 or by dissolving in a water/alcohol solvent mixture.

The dye employed in the present invention is an oxidatively bleachable dye, which has an oxidation reduction potential higher than that of the silver(I)/silver(II) pair at the oxidative bleaching pH. Representative dyes are azo dyes, anthraquinone dyes and the like. Representative examples of these dyes are described in *Color Index,* Vol. 4, 3rd Edition, The Society of Dyers and Colorist. Of these dyes, azo dyes- monoazo (C.I. 11000–19999), bisazo (20000–29999), trisazo (30000–34999), polyazo (35000–36999), triarylmethane dyes (C.I. 42000–44999), acridine dyes (46000–46999), azine dyes (C.I. 50000–50999), anthraquinone dyes (C.I. 58000–72999) are particularly suitable.

All of the dyes which are conventionally employed in a silver dye bleach process can also be used in the present invention.

Yellow dyes generally employed include azo dyes such as Direct Fast Yellow GC (Color Index No. (C.I.) 29000), Sirium Supra Yellow R (C.I. 29025), Chrysophenine (C.I. 24895), etc., benzoquinone type, anthraquinone type, polycyclic type soluble vat dyes, vat dyes such as Indigosol Yellow HCGN (C.I. 56006), Indigosol Golden Yellow IGK (C.I. 59101), Indigosol Yellow 2GB (C.I. 61726), Algosol Yellow GCA-CF (C.I. 67301), Indigosol Yellow V (C.I. 60531), Indanthrene Yellow 4GF (C.I. 68420), Indanthrene Yellow G (C.I. 70600), Mikethren Yellow GC (C.I. 67300), Indanthrene Yellow 4GK (C.I. 68405), etc.

Magenta dyes include azo dyes such as Nippon Fast Red BB (C.I. 29100), Sirium Supra Rubin B (C.I. 25380), Sumilight Supra Rubinol B (C.I. 29225), Benzobrilliant Geranin B (C.I. 15080), etc., soluble vat dyes consisting of indigoid type, benzoquinone type and anthraquinone heteropolycyclic compounds such as Indigosol Brilliant Pink IR (C.I. 73361), Indigosol Red Violet IRH (C.I. 73386), Indigosol Violet 15R (C.I. 59321), Indigosol Red Violet IRRL (C.I. 59316), Indigosol Red IFBB (C.I. 67001), Indanthrene Red Violet RRK (C.I. 67895), Mikethren Brilliant Violet VVK (C.I. 63355), etc.

Further, cyan dyes include azo dyes such as Direct Sky Blue 6B (C.I. 22610), Direct Blue 2B (C.I. 22610), Direct Brilliant Blue RW (C.I. 24280), Sumilight Supra Blue G (C.I. 34200), etc., phthalocyanine type compounds such as Sumilight Supra Turkish Blue G (C.I. 74180), Mikethren Brilliant Blue 4G (C.I. 74140), etc., azo dyes and vat dyes such as Indanthrene Turkish Blue 3 GK (C.I. 67915), Indanthrene Blue 5G (C.I. 69845), Indanthrene Blue GCD (C.I. 69810), Indigosol 04B (C.I. 73066), Anthrasol Green IB (C.I. 59826), etc.

In addition, the dyes described in U.S. Pat. Nos. 2,286,714, 2,286,837, 2,294,892, 2,294,893, 2,418,624, 2,420,630, 2,420,631, 2,612,448, 2,629,658, 2,705,708, 2,694,636, 3,002,964, 3,114,634 and 3,119,811, the disclosures of which are incorporated herein by reference, may be employed.

The dyes which are incorporated into the photographic element employed in accordance with the present invention are bleachable dyes and preferably non-diffusible dyes, which are known in this art. The term "bleachable dye" referred to herein also includes dye precursors, i.e., compounds which are colored during processing of the photographic element. The term "non-diffusible dye" means a bleachable dye which itself is non-diffusible in the emulsion, or a dye which can be rendered non-diffusible by using a suitable mordant, e.g., compounds such as described in U.S. Pat. No. 2,882,156. The photographic element of the present invention can be, irrespective of color or neutral (e.g., black-and-white) images, one having a single emulsion coating for obtaining monochrome dye images produced from one kind of a dye or a dye mixture. A representative example of useful neutral dyes for such a material is an azo dye as described in British Pat. No. 999,996. In addition, the photographic element of the present invention can possess a number of coatings in the respective layers of which are incorporated differently bleachable dyes to form color images. Particularly useful is an element provided with at least three light-sensitive emulsion layers, non-diffusible yellow-, magenta- and cyan dyes are incorporated into the respective layers sensitized to blue, green and red light, respectively.

The emulsions employed in the present invention as discussed above contain a bleachable dye. However, it is also possible to incorporate the bleachable dye into an alkali-permeable layer adjacent the emulsion layer, and this is sometimes more preferred. Particularly, when a layer containing the bleachable dye is provided under the emulsion layer, the speed is increased. As such, one example of useful configuration includes an element comprising a support having provided thereon the following layers in succession: a blue sensitive silver halide-containing layer; a bleachable yellow dye-containing layer; a green sensitive silver halide-containing layer; a bleachable magenta dye-containing layer; a red sensitive silver halide-containing layer; a bleachable cyan dye-containing layer.

The dye incorporated into a processing bath in the present invention is a diffusible water-soluble dye. In this case, it is desired that the dye be anchored to the gelatin in the photographic element to render it non-diffusible. By using a suitable mordant in the photographic element, the diffusible dye can be rendered non-diffusible.

Suitable mordants are, for example, polymers described in British Pat. No. 685,475, U.S. Pat. Nos. 2,675,316, 2,839,401, 2,882,156, 3,048,487, 3,184,309 and 3,445,231, German Patent Application (OLS) No. 1,914,362, Japanese Patent Application (OPI) Nos. 47624/1975 and 71332/1975 (The term "OPI" as used herein refers to a "published unexamined Japanese patent application"), etc.

The polymer is preferably present in the photographic element in an amount of 100 mg to about 10 g polymer per square meter. The weight ratio of polymer to gelatin is about 0.04 to about 4.0 and preferably about 0.1 to about 1.0. More importantly, the polymer should be present in an amount such that the pyridine unit of the polymer is present in an amount of 0.5 to 50 per molecule of AgX, preferably 1.0 to 20.

When the dye is present in the element, it is present in an amount of about 0.1 to 5 g/m$^2$ and preferably 0.5 to 3 g/m$^2$. When it is used in a separate processing solution, it is present in an amount of about 5 to 50 g/l and preferably about 5 to 20 g/l.

The photographic element employed in the present invention contains silver salts and/or metal silver. Examples of silver salts include light-sensitive silver salts, e.g., silver halides such as silver chloride, silver bromide, silver iodide, silver chlorobromide, silver iodobromide, silver iodochlorobromide, etc., organic silver salts such as silver behenate, etc. As metal silver, there is metal silver of finely divided grains represented by colloidal silver.

Separately, light-sensitive materials of non-silver salt type such as zinc oxide can also be employed as a light-sensitive material of the present invention. In this case, after exposure, physical development is performed using silver salts to obtain imagewise distribution of silver. In addition, a silver nuclei can also be formed utilizing the physical development as described in Dutch Pat. No. 6,603,640, German Pat. No. 1,216,685, U.S. Pat. No. 3,157,502, etc.

The composition of the dye bleaching bath which is employed in the present invention contains at least one kind of the oxidizing agent. In addition, if necessary, pH buffering agents such as phosphates, carbonates, etc., salts such as sulfates, perchlorates, nitrates, etc., alkalis such as sodium hydroxide, ammonium hydroxide, etc., acids such as sulfuric acid, phosphoric acid, acetic acid, citric acid, etc., may be added thereto. The addition amount of the oxidizing agent is $1\times10^{-3}$ to 2 mols/l, preferably $5\times10^{-3}$ to 1 mol/l, more preferably $1\times10^{-2}$ to $5\times10^{-1}$ mol/l. The pH of the dye bleaching bath is preferably 2 to 7, more preferably 2 to 5.

When the oxidizing agent is present in the photographic element, it is preferably present in an amount of about 0.01 to about 0.2 mol/m$^2$ and more preferably of about 0.02 to about 0.1 mol/m$^2$.

Typical examples of developers which are employed for imagewise formation of developed silver from the light-sensitive material containing silver halide include developers containing at least one developing agent such as aminophenols, e.g., 4-(N-methylamino)phenol, N,N-diethyl-p-aminophenol; 3-pyrazolidones such as 1-phenyl-3-pyrazolidone, 4,4-dimethyl-1-phenyl-3-pyrazolidone, 4-methyl-4-hydroxymethyl-1-phenyl-3-pyrazolidone, 4,4-dihydroxymethyl-1-phenyl-3-pyrazolidone; dihyroxybenzenes such as hydroquinone, methylhydroquinone, chlorohydroquinone catechol, 4-phenylcatechol; ascorbic acid, p-phenylenediamines. In addition, the following additives are added to the developer when necessary. For example, as alkali agents, buffering agents, etc., sodium hydroxide, potassium hydroxide, sodium carbonate, potassium carbonate, sodium or potassium tertiary phosphate, potassium metaborate, borax, etc., are employed singly or in combination. In addition, for purposes of imparting buffering capability for preparational convenience or for enhancing ion strength, and the like, a variety of salts such as hydrogen disodium or dipotassium phosphate, sodium or potassium dihydrogen phosphate, sodium or potassium bicarbonate, boric acid, alkali nitrates, alkali sulfates, etc., are employed.

If necessary, development accelerators can be added to the developer. For example, there can be employed a variety of pyridinium compounds, other cationic compounds, cationic dyes such as photosafranine, neutral salts such as thalium nitrate or potassium nitrate as described in U.S. Pat. No. 2,648,604, Japanese Patent Publication No. 9503/1969 and U.S. Pat. No. 3,671,247, nonionic compounds such as polyethylene glycol or derivatives thereof, polythioethers, etc., as described in Japanese Patent Publication 9504/1969, U.S. Pat. Nos. 2,533,990, 2,531,832, 2,950,970 and 2,577,127, organic solvents, organic amines, ethanolamine, ethylenediamine, diethanolamine, etc., as described in Japanese Patent Publication No. 9509/1969, Belgian Pat. No. 682,862, accelerators as described in A. Mason, *Photographic Processing Chemistry*, pages 40–43, published by Focal Press, London (1966). In addition, benzyl alcohol and phenylethyl alcohol as described in U.S. Pat. No. 2,515,147, pyridine, ammonia, hydrazines and amines as described in *Nippon Shashin Gakkai Shi* (*Journal of Japanese Photographic Academy*), Vol. 14, page 74 (1952) are also useful development accelerators.

Further, sodium sulfite, potassium sulfite, potassium bisulfite or sodium bisulfite which are generally employed as preservatives can also be used.

In the present invention, optional anti-fogging agents can be added to the developer, as necessary. As the anti-fogging agents, there can be employed alkali metal halides such as potassium bromide, sodium bromide, potassium iodide, etc., and organic anti-fogging agents. Typical examples of organic anti-fogging agents which can be used are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole; mercapto-substituted heterocyclic compounds such as 1-phenyl-4-mercaptotetrazole, 2-mercaptobenzimidazole, 2-mercaptobenzothiazole; mercapto-substituted aromatic compounds such as thiosalicylic acid. The addition amount thereof is in a range of 1 mg to 5 g per l of the developer, preferably 5 mg to 1 g.

In addition, polyphosphoric acid compounds represented by sodium hexametaphosphate, sodium tetrapolyphosphate, sodium tripolyphosphate or potassium salts of these polyphosphoric acid compounds; and aminopolycarboxylic acids represented by phosphonocarboxylic acid, ethylenediaminetetraacetate, nitrilotriacetate, cyclohexanediaminetetraacetate, iminodiacetate, N-hydroxymethylethylenediaminetriacetate, diethylenetriaminepentaacetate, etc., can be employed as softeners for hard water. The addition amount thereof varies depending upon hardness of water used, but generally they are used in an amount of 0.5 to 1 g/l approximately. Other calcium or magnesium sequestering agents can also be used in the photographic processing solution. These agents are described in detail in J. Willems, *Belgische Chemische Industrie,* Vol. 21, page 325 (1956) and ibid., Vol. 23, page 1105 (1958).

In addition, the developer can also be employed as a monobath developing fixing solution by adding a silver halide solvent. As the silver halide solvent, fixing agents which are well known in the art are employed. Specific examples of these solvents are thiosulfates such as sodium thiosulfate, potassium thiosulfate; thiocyanates such as potassium thiocyanate, sodium thiocyanate; organic amines such as alkanolamines; thioether compounds, etc. The mono bath developing fixing solution is described in L. F. A. Mason, *Photographic Processing Chemistry,* pages 156–160, published by Focal Press (1966).

The most general color photographic element which is subjected to photographic processing in accordance with the method of the present invention comprises a support having provided thereon at least one silver halide emulsion layer, more specifically, a support having provided thereon a red sensitive silver halide emulsion layer, a green sensitive silver halide emulsion layer and a blue sensitive silver halide emulsion layer. In general, the element comprises a support having provided thereon a red sensitive silver halide emulsion layer containing a cyan dye, a green sensitive silver halide emulsion layer containing a magenta dye and a blue sensitive silver halide emulsion layer containing a yellow dye, respectively, by at least one thereof. Such a photographic element may be provided with a non-light sensitive photographic layer (e.g., an antihalation layer, an intermediate layer for preventing color mixing, etc., a yellow filter layer, a protective layer, etc.). In addition, there is no limitation on configuratory order of the red sensitive layer, green sensitive layer and blue sensitive layer. The dye can be present in the same layer in which silver halide is contained and can also be present in the layer adjacent thereto.

In the color light-sensitive material which is subjected to photographic processing in accordance with the method of the present invention, any one of silver bromide, silver chloride, silver chlorobromide, silver iodobromide and silver iodochlorobromide can be employed as silver halides to be contained in the photographic emulsion layer(s). Where two or more photographic emulsions are possessed, two or more of these silver halides can also be employed in combination. The photographic emulsion can be prepared in a conventional method, e.g., in accordance with the method as described in P. Grafkides, *Chimie Photographique,* published by Paul Montel Co., (1967); the emulsion can be prepared in any of an ammonia method, a neutral method and an acidic method; a single jet method, a reversed mixing method, a double jet method, a control double jet method, and the like.

The crystalline form of these silver halide grains can be any one of cubic form, hexagonal form and a mixture thereof. The crystalline structure of the silver halide grains can be uniform even in the internal portions thereof, or can be a layered structure of different internal and external portions, or can be so-called conversion type as described in British Pat. No. 635,841 and U.S. Pat. No. 3,622,318. Further, the silver halide grains can also be a type in which latent images are mainly formed on the surface of the grains ("external latent image type") or can be an inner latent image type in which latent images are formed inside the grains ("internal latent image type").

The silver halide emulsion can be chemically sensitized in a known manner. For this purpose, for example, sulfur compounds as described in U.S. Pat. No. 1,574,944, etc.; gold compounds as described in U.S. Pat. No. 2,399,083, etc.; noble metal compounds such as platinum, palladium, iridium, rhodium, ruthenium, etc., as described in U.S. Pat. Nos. 2,448,060 and 2,598,079, British Pat. No. 618,061; reducible substances such as stannous salts, amines, and the like can be employed.

Gelatin is generally employed as a hydrophilic colloid in the silver halide emulsion layers and other layers of the light-sensitive element which is subjected to photographic processing in accordance with the present invention, but other hydrophilic colloids can also be used. For example, gelatin derivatives, graft polymers of gelatin with other high molecular weight substances, cellulose derivatives such as hydroxyethyl cellulose, carboxymethyl cellulose, cellulose sulfates, etc.; sugar derivatives, sodium alginate, starch derivatives, etc.; a variety of synthetic hydrophilic high molecular substances such as homopolymers or copolymers, e.g., polyvinyl alcohol, polyvinyl alcohol partial acetal, poly-N-vinylpyrrolidone, polyacrylates, polymethacrylates, polyacryl amides, polyvinylimidazole, polyvinylpyrazole, etc., can be employed.

As gelatin, there are, in addition to lime-treated gelatin, acid-treated gelatin, gelatin derivatives are useful, for example, the reaction products of gelatin and acid halides, acid anhydrides or isocyanates.

The light-sensitive element may further contain hardeners as described in U.S. Pat. No. 3,325,287; plasticizers such as compounds as described in U.S. Pat. No. 3,775,128 or glycerine; alkylbenzenesulfonic acids, alkylene oxide condensates; compounds as described in U.S. Pat. Nos. 2,739,891 and 3,415,649 and other surface active agents; other additives for improving photographic properties, image properties and mechanical properties of the light-sensitive element.

The photographic element which is processed in accordance with the present invention can contain U.V. absorbants in the hydrophilic colloid layer(s). For example, there can be employed benzotriazole compounds substituted with an aryl group (e.g., those as described in U.S. Pat. No. 3,533,794), 4-thiazolidone compounds (e.g., those as described in U.S. Pat. Nos. 3,314,794 and 3,352,681), benzophenone compounds (e.g., those as described in Japanese Patent Application (OPI) No. 2784/1971), cinnamic acid ester compounds (e.g., those as described in U.S. Pat. Nos. 3,705,805 and 3,707,375), or benzoxazole compounds (e.g., those as described in U.S. Pat. No. 3,497,762).

The hydrophilic colloid layer(s) of the light-sensitive element which is processed in accordance with the present invention can contain whitening agents such as stilbene type, triazine type, oxazole type or coumarine type. These agents can be water-soluble or can be employed in the form of a dispersion of water-insoluble whitening agents. Specific examples of fluorescent whitening agents are described in U.S. Pat. Nos. 2,632,701, 3,269,840 and 3,359,102, British Pat. No. 1,319,763, etc.

Exposure of the photographic element processed in accordance with the present invention can be performed in a conventional manner. That is, any one of a variety of known light sources such as natural light (sunlight), a tungsten lamp, a fluorescent lamp, a mercury lamp, a xenon arc lamp, a carbon arc lamp, a xenon flash lamp, a cathode ray tube flying spot, etc., can be employed. Exposure time can be not only exposure time of 1/1,000 to 1 second which is ordinarily employed in camera, but also shorter exposure than 1/1,000 second, e.g., exposure of $1/10^4$ to $1/10^6$ second using a xenon flash lamp or a cathode ray tube can be used, and further longer exposure than 1 second can also be used. Depending upon the need, the spectral composition of light used for exposure can be controlled using a color filter. Laser light can also be employed for exposure. In addition, exposure can be made by light emitted from excited fluorescent substances by means of electron rays, X-rays, gamma rays, alpha rays, etc.

The method of the present invention is superior to conventional methods in the following aspects. That is:

(1) Color images having excellent light fastness, heat resistance and humidity resistance are obtained in comparison to conventional color development process.

(2) The amount of the silver or silver salts in the light-sensitive material can be markedly reduced as compared to conventional color developing process such as conventional silver dye bleach processes and color intensifying processes.

(3) The layer thickness of the emulsion layer becomes thin by reducing the amount of high molecular weight substance media such as silver or silver salts and gelatin in the light-sensitive material so that sharpness of images is increased.

(4) Any chemicals such as p-phenylenediamine derivatives which are employed in color developing process and are hazardous to human body, e.g., by poisoning skin, or any strongly acidic processing bath having large corrosiveness are not used.

(5) As compared to the color intensifying process using cobalt(III) complex and hydrogen peroxide, etc., processing step is simple and stability of processing solution is large.

The present invention will be more specifically explained by reference to the examples below, but the present invention should not be construed as being limited to these embodiments.

EXAMPLE 1

Onto a polyethylene base provided with a subbing layer, a layer containing a cyan dye (1,612 mg/m$^2$) of the structure indicated below and silver halide emulsion (4 mol% of silver iodide; mean grain size: 0.7 micron; 100 mg/m$^2$) in a binder of 1.9 g/m$^2$ gelatin and 2.1 g/m$^2$ poly-4-vinylpyridine (molecular weight: 60,000) in a 1:1 weight ratio was applied and a gelatin was provided thereon as protective layer (gelatin 1 g/m$^2$) to prepare a photographic element (Sample I).

For comparison, the same photographic element as Sample I was prepared except no polyvinylpyridine was contained in the cyan dye-containing layer (Sample II).

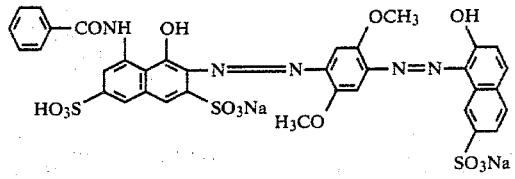

These photographic elements were exposed to light of 1,000 CMS at the maximum through an optical wedge using a tungsten lamp of 2,854° K., followwed by the processings A and B below, respectively.

Processing A (Processing in accordance with the present invention)

| Processing Step | Processing Temperature (°C.) | Processing Time (min) |
|---|---|---|
| Developing | 25 | 4 |
| Water Washing | 25 | 1 |
| Fixing | 25 | 3 |
| Water Washing | 25 | 1 |
| Dye Bleaching | 40 | 2–5 |
| Water Washing | 25 | 1 |
| Bleach-Fixing | 25 | 3 |
| Water Washing | 25 | 2 |
| Composition of processing solution: | | |
| Developer | | |
| Ethylenediaminetetraacetate (disodium salt) | | 1 g |
| Sodium Sulfite | | 60 g |
| Hydroquinone | | 10 g |
| Sodium Hydroxide | | 5 g |
| 1-Phenyl-3-pyrazolidone | | 0.4 g |
| Diethylene Glycol | | 20 cc |
| Sodium Carbonate | | 20 g |
| Potassium Bromide | | 9 g |
| Water to make | | 1 l |
| Dye Bleaching Solution | | |
| Monosodium Phosphate (dihydrate) | | 60 g |
| Potassium Persulfate | | 40.5 g |
| Water to make | | 1 l |
| Bleach Fixing Solution | | |
| Ammonium Thiosulfate | | 150 ml |
| Sodium Sulfite | | 5 g |
| Na[iron(III)-ethylenediaminetetraacetic Acid Complex] | | 40 g |
| Ethylenediaminetetraacetic Acid (disodium salt) | | 4 g |
| Water to make | | 1 l |

Processing B (Silver dye bleach process for comparison)

| Processing Step | Processing Temperature (°C.) | Processing Time (min) |
|---|---|---|
| Developing | 25 | 4 |
| Water Washing | 25 | 2 |
| Dye Bleaching | 40 | 7–13 |
| Water Washing | 25 | 1 |
| Bleach Fixing | 25 | 3 |
| Water Washing | 25 | 3 |
| Composition of Processing Solution | | |
| Developer: | | |
| Same as in Processing A | | |
| Dye Bleaching Solution: | | |

-continued

| Processing Step | Processing Temperature (°C.) | Processing Time (min) |
|---|---|---|
| Conc. Hydrochloric Acid | | 100 ml |
| Phenazine | | 18 mg |
| Thiourea | | 100 g |
| Water to make | | 1 l |
| Bleach Fixing Solution: | | |
| Same as in Processing A | | |

The results obtained are shown in Table 1.

TABLE 1

| Sample | Processing | Dye Bleaching Time (min) | Cyan Maximun Density | Cyan Minimum Density | Gamma |
|---|---|---|---|---|---|
| (I) (invention) | A (invention) | 1.0 | 2.00 | 0.12 | 0.27 |
| | | 1.5 | 1.98 | 0.01 | 0.60 |
| | | 2.0 | 1.96 | 0.01 | 0.60 |
| (II) (comparison) | B (comparison) | 7 | 2.00 | 1.56 | 0.24 |
| | | 10 | 2.01 | 1.55 | 0.25 |
| | | 13 | 2.00 | 1.55 | 0.25 |

Applying the conventional silver dye bleach process (Processing B) to the low content silver light-sensitive material employed in this example (the molar ratio of silver and the dye being 1:2), bleaching occurred only incompletely since the process required an equimolar amount of silver for bleaching the dye. On the other hand, in Processing A of the present invention, bleaching was sufficiently effected because silver acted catalytically such that cyan positive images having low minimum density were obtained. In addition, by prolonging the dye bleaching time, the sensitivity could be enhanced.

EXAMPLE 2

A sample prepared as Sample I of Example 1 except for replacing the cyan dye by a magenta dye (2,380 mg/m$^2$) of the formula indicated below was exposed to light under the same conditions as in Example 1, followed by Processing A of Example 1.

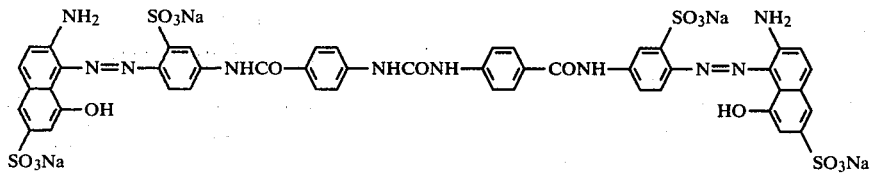

After the dye bleach processing for 2 minutes, magenta positive images having the maximum magenta density of 2.10, the minimum magenta density of 0.08, and gamma of 0.62 were obtained.

EXAMPLE 3

A sample prepared as Sample I of Example 1 except for replacing the cyan dye by a yellow dye (1,580 mg/m$^2$) of the following structure was exposed under the same conditions as in Example 1, followed by Processing A of Example 1.

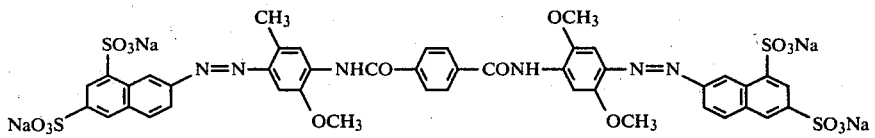

After dye bleach processing for 7 minutes, yellow positive images having the maximum yellow density of 2.02, the minimum yellow density of 0.15 and gamma of 0.52 were obtained.

EXAMPLE 4

A sample prepared in the same manner as Sample I of Example 1 was exposed to light and then processed in a manner similar to Example 1 using the same processing solutions of Processing A except that the pH of the dye bleaching solution was varied from 2.0 to 6.0. The results obtained are shown in Table 2.

TABLE 2

| pH of Dye Bleach Solution | Maximum Cyan Density | Minimum Cyan Density |
|---|---|---|
| 2.0 | 2.00 | 1.90 |
| 3.0 | 2.00 | 0.14 |
| 4.0 | 1.98 | 0.08 |
| 5.0 | 1.97 | 0.08 |
| 6.0 | 2.00 | 0.48 |
| Dye bleaching time: 2 minutes | | |

It is understood from the results in Table 2 that the optimum pH of the dye bleaching solution in the processing of Example 1 was approximately 3 to 5.

EXAMPLE 5

A sample similar to Sample I prepared in Example 1 was prepared except that copoly(4-vinylpyridine-n-butyl-4-vinylpyridinium bromide) was used in place of the poly-4-vinylpyridine. This sample was processed in a manner similar to Example 1. Good cyan images were obtained.

While the invention has been described in detail and with reference to specific embodiments thereof, it will be apparent to one skilled in the art that various changes and modifications can be made therein without departing from the spirit and scope thereof.

What is claimed is:

1. A method for forming color images which comprises exposing a color photographic light-sensitive element containing a dye, a polymer containing at least 30 mol% of a vinylpyridine represented by the formula:

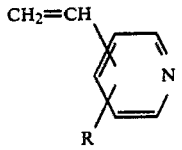

wherein R is a hydrogen atom or an alkyl group and silver halide, forming developed silver imagewise by development processing and then processing with an aqueous solution containing peroxoic acids or salt thereof to thereby oxidatively bleach said dye.

2. The method for forming color images of claim 1, wherein said polymer is present in said photographic element.

3. The method for forming color images of claim 1, wherein said polymer contains at least 50 mol% of the vinylpyridine.

4. The method for forming color images of claim 1, wherein said vinylpyridine is selected from 2-vinylpyridine, 3-vinylpyridine, 4-vinylpyridine and 2-methyl-5-vinylpyridine.

5. The method of claim 1, wherein said oxidizing agent is present in a silver halide emulsion layer, in a layer adjacent a silver halide emulsion layer or in a separate processing solution.

6. The method of claim 5, wherein said oxidizing agent is present in the silver halide emulsion layer or a layer adjacent the silver halide emulsion layer and is present in an amount of about 0.01 to 0.2 mol/$m^2$.

7. The method of claim 5, wherein said oxidizing agent is present in a separate processing solution in an amount of $1\times10^{-3}$ to 2 mols/l.

8. The method of claim 7, wherein said oxidizing agent solution has a pH of about 2 to 7.

9. The method of claim 1, wherein said polymer is present in said silver halide emulsion layer or in a layer adjacent said silver halide emulsion layer.

10. The method of claim 9, wherein said polymer is present in an amount of about 100 mg/$m^2$ to 10 g/$m^2$.

11. The method of claim 1, wherein said dye is present in the silver halide emulsion layer, a layer adjacent said silver halide emulsion layer or in a separate processing solution.

12. The method of claim 11, wherein said dye is present in said silver halide emulsion layer or said adjacent layer in an amount of about 0.1 to 0.5 g/$m^2$.

13. The method of claim 11, wherein said dye is present in a separate processing solution in an amount of 5 to about 50 g/l.

14. The method of claim 11, wherein said dye is an azo dye or an anthraquinone dye.

15. The method of claim 1, wherein said oxidizing agent has an oxidation-reduction potential higher than that of a silver(I)/silver(II) pair in the presence of polyvinylpyridine at the oxidative processing pH.

16. The method of claim 1, wherein said dye has an oxidation potential less than that of the silver(I)/silver(II) pair in the presence of polyvinylpyridine at the oxidative processing pH.

* * * * *